United States Patent [19]

Wilks

[11] Patent Number: 4,570,409

[45] Date of Patent: Feb. 18, 1986

[54] FOUNDATION SYSTEM FOR MODULAR AND MOBILE HOUSING

[75] Inventor: David R. Wilks, Plano, Tex.

[73] Assignee: Palm Harbor Homes, Inc., Dallas, Tex.

[21] Appl. No.: 558,906

[22] Filed: Dec. 7, 1983

[51] Int. Cl.[4] ..... E04G 21/00

[52] U.S. Cl. ..... 52/742; 52/169.8; 52/169.13

[58] Field of Search ..... 52/297–299, 52/169.8, 169.9, 169.14, 169.13, 125.4, 125.5, 126.1, 126.6, 263, DIG. 3, 743, 742; 405/229, 230, 231, 239

[56] References Cited

U.S. PATENT DOCUMENTS

| | | | |
|---|---|---|---|
| 2,027,511 | 1/1936 | Bertran | 405/239 |
| 2,858,694 | 11/1958 | Akins et al. | 52/294 |
| 3,608,928 | 9/1971 | Hooker | 52/DIG. 3 |
| 3,713,259 | 1/1973 | Tkach | 52/125.6 |
| 3,820,024 | 8/1974 | Warnke | 52/126.7 |
| 4,453,862 | 6/1984 | Stenne | 52/743 |

FOREIGN PATENT DOCUMENTS

| | | | |
|---|---|---|---|
| 935797 | 9/1963 | United Kingdom | 405/239 |

*Primary Examiner*—James L. Ridgill, Jr.
*Attorney, Agent, or Firm*—Michael A. O'Neil

[57] ABSTRACT

A foundation system for housing modules comprises a plurality of pier columns (10) each comprising a bore hole (12) formed in the earth and having a concrete reinforcing structure (16) positioning therein. A body of concrete (24) is poured into the bore hole and an outer support member (30) is positioned in the body of concrete (24) prior to the setting thereof. A inner support member (32) is telescopingly receiving in the outer support member (30). A module (40) including a chassis (42) comprising a steel beam (44) is positioned above the pier column (10). The inner support member (32) is extended into engagement with the steel beam (44) and is welded, both to the steel beam and to the outer support member. In this manner the pier column (10) supports the housing module.

13 Claims, 6 Drawing Figures

FOUNDATION SYSTEM FOR MODULAR AND MOBILE HOUSING

TECHNICAL FIELD

This invention relates generally to foundation systems for buildings, and more particularly to an economical, easily installed foundation system that is particularly adapted for use with mobile and modular housing.

BACKGROUND AND SUMMARY OF THE INVENTION

Homes and similar residential dwelling units have traditionally been constructed on-site. Moreover, residential dwelling units have typically been constructed on an individual unit basis, even in the case of construction projects wherein the individual homes are largely identical. These factors, plus delays caused by weather, unavailability of materials, etc. have combined to dramatically increase the cost of homes constructed in the conventional manner.

As opposed to the foregoing, mobile homes are almost universally constructed in factories. By means of automation, standardization, and other mass production techniques, the costs of manufacturing mobile homes has remainded relatively low. Thus, when compared on a per square foot basis, homes constructed by conventional techniques typically cost up to five times as much as mobile homes.

The relatively new concept of modular housing combines the best features of traditional construction and mobile home manufacturing to provide residential dwelling units which are economical to purchase and yet afford many of the amenities that have heretofore been unavailable at reasonable prices. Each home is constructed from one or more modules which are entirely constructed at a factory utilizing mass production techniques. This is advantageous not only from the standpoint of economy, but also because it facilitates the subsequent expansion of the home by simply adding more modules. The completed modules are transported from the factory to the homesite in the manner of a mobile home. At the site the modules are removed from the transportation apparatus and are installed on a permanent foundation. Walks and driveways, patios, decks, pools, hot tubs, and other amenities usually found only in expensive custom homes are then added to complete the construction of the modular home.

One factor that is heretofore added unnecessarily to the cost of modular housing involves the construction of the foundation at the homesite. Thus, traditional foundation construction techniques require a relatively large number of construction personnel to visit the homesite on at least two occasions. On the first trip the necessary excavation work is completed, forms are constructed, reinforcing structure is constructed within the forms, and the concrete is poured. On the second trip the forms are removed and the excavation is backfilled to the extent necessary. It will thus be understood that considerable costs savings can be realized by providing a foundation construction technique that does not require the construction personnel to make a return trip to the homesite simply for the purpose of removing the forms and backfilling the excavation. On the other hand, proper module housing construction requires the precise leveling and alignment of the individual modules at the time of installation on the permanent foundation. Thus, a need exists for a foundation system adapted for use in conjunction with module housing which is both economical and yet affords very accurate positioning of individual modular units.

The present invention relates to a foundation system for modular housing which fulfills the foregoing and other requirements to provide significant improvements over the prior art. In accordance with the broader aspects of the invention, the modules comprising a modular housing installation are supported on a series of pier columns. Each pier column is constructed by forming a bore hole in the earth, installing suitable reinforcing structure in the bore hole, and then filling the bore hole with concrete. Each pier column further comprises an outer support member embedded in the concrete and projecting upwardly therefrom and an inner support member telescopingly received in the outer support member.

In the installation of modular housing units, each module is positioned over the pier columns comprising the foundation system of the present invention utilizing the transportation apparatus. Jacks are employed to level and align each module. The inner support member of each pier column is then secured, both to the chassis of the module and to the outer support member. When the inner support members of all of the pier columns have been secured, the transportation apparatus and the jacks are removed, whereupon the installation of the module is complete. If desired, a suitable exterior wall may be constructed to give the installation a more completed appearance.

In accordance with more specific aspects of the invention, the outer and inner support members of each pier column preferably comprises steel tubes. Since steel beams are often employed as chassis components in the construction of modules for modular housing installations, the construction of the outer and inner support members of the pier columns from steel allows the connection of the inner support members both to the chassis of the module and to the outer support member by means of welding. Although other techniques may be used to secure the inner support members in place, the use of welding is preferred because it is rapid, economical and permanent in nature.

DESCRIPTION OF THE DRAWINGS

A more complete understanding of the invention may be had by reference to the following Detailed Description when taken in conjunction with the accompanying Drawings wherein.

DETAILED DESCRIPTION

Figure 1:
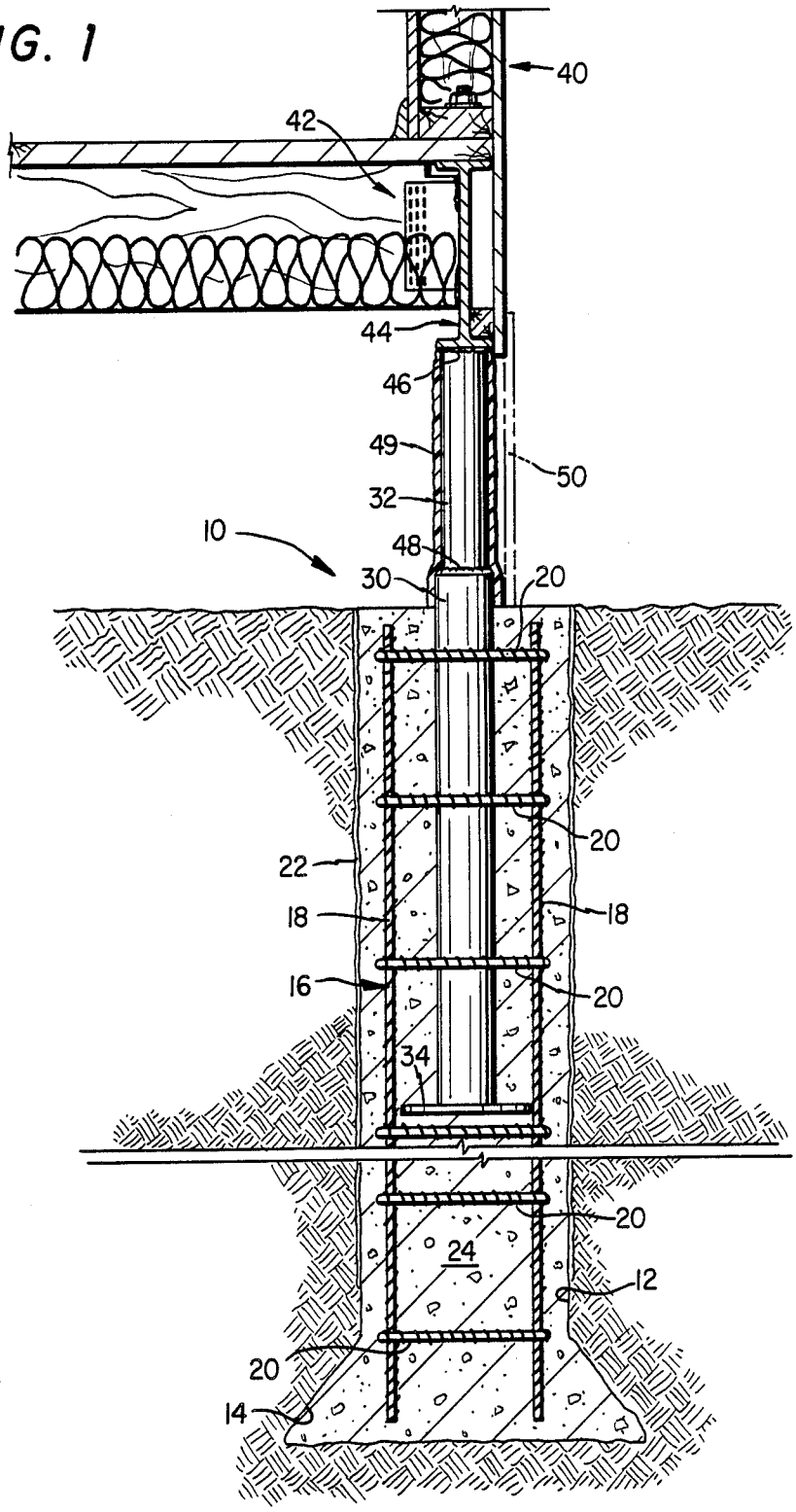
FIG. 1 is vertical sectional view showing a foundation post incorporating the present invention.

Referring now to the Drawings, and particularly to FIG. 1 thereof, there is shown a foundation pier column 10 incorporating the present invention. The foundation pier column 10 is formed by first forming a bore hole 12. The bore hole 12 extends vertically downwardly into the earth at a predetermined location depending upon the desired positioning of a modular housing installation. The bottom of the bore hole 12 may be provided with an undercut bell 14, if desired. The bore hole 12 may be formed utilizing various types of commercially available drilling machines, for example, drilling machines of the type utilized in forming pier holes for pier and beam foundations may be utilized in the practice of the invention, if desired.

Although the precise diameter of the bore hole 12 is not critical to the practice of the invention, the use of bore holes having a diameter of one foot is typical. The total depth of each bore hole 12 depends upon the type and strength of the soil in which the foundation pier column 10 is installed, the diameter of the bore hole, the spacing between adjacent bore holes, the dead load of the structure of being supported, and the design loads of the supported structure. By way of example, in one practical application of the invention, the minimum depth of the bore holes 12 is seven feet.

After the bore hole 12 is completed, a reinforcing structure 16 is positioned therein. The reinforcing structure 16 is preferably comprised of four longitudinally extending members 18 which are formed from #4 reinforcing bars and a plurality of transversely extending ties 20 formed from #3 reinforcing bars, it being understood that the size of the longitudinally extending members 18 and of the ties 20 depends upon the design parameters of the reinforcing structure 16. The longitudinally extending members 18 are preferably situated in a rectangular array, and the ties 20 are preferably located at one foot intervals. When the foundation pier 10 is installed in an expansive cohesive type soil, the bore hole 12 is provided with a liner 22. When employed, the liner 22 preferably comprises two layers of 8 mil polyethylene film sprayed with oil. After the reinforcing structure 16, and if necessary the liner 22 are installed in the bore hole 12, the bore hole 12 is filled with a quantity of concrete 24. The concrete utilized in the practice of the invention is preferably of the type having a strength of 3000 psi at 28 days.

The foundation pier column 10 further includes an outer support member 30 and an inner support member 32. The outer support member 30 is preferably formed from 2½" diameter standard A53 grade B steel pipe. The bottom of the outer support member 30 is covered by a plate 34 comprising a ¼" thick by 4" square A36 steel plate. The plate 34 performs several functions in the practice of the invention, including preventing concrete from entering the outer support member 30, stablizing the outer support member 30 against upward or downward movment, and facilitating the precise vertical alignment of the outer support member 30 and therefore the inner support member 32.

The inner support member 32 preferably comprises 2" diameter standard A53 grade B steel pipe. The use of 2 ½" diameter steel pipe for the outer support member 30 and the use of 2" diameter steel pipe for the inner support member 32 is advantageous in that 2" pipe is slideably received within 2½" pipe without allowing for undue play therebetween.

At least the outer support member 30 is positioned in the bore hole 12 either prior to the receipt of the concrete 24 therein, or at least prior to any significant setting of the concrete. Substantially the full length of the outer support member 30 is received in the body of concrete 24. A short length of the outer support member 30 extends above the upper end of the bore hole 12 and the upper end of the concrete 24 received therein to prevent the entry of debris into the outer support member 30. Although the precise longitudinal positioning of the outer support member 30 is not critical to the practice of the invention, it is important that the axis of the outer support member 30 extend in a substantially vertical orientation.

The outer support member 30 has a length of about 3'10". The inner support member 32 preferably has a maximum length of 4'2". The inner support member 32 is initially fully received in the outer support member 30. Thus, the upper end of the inner support member 32 is initially positioned approximately 4" above the upper end of the outer support member 30. The inner support member 32 may be positioned within the outer support member 30 either prior to or after the positioning of the outer support member 30 in the body of concrete 24.

The pier column 10 comprises part of a foundation system for supporting a module 40 of a modular housing installation. The module 40 includes a chassis 42 including longitudinally extending steel beams 44. The construction of the chassis 42 is fully disclosed in copending application Ser. No. 517,582 filed July 27, 1983, entitled CHASSIS FOR MANUFACTURED HOUSING the disclosure of which is incorporated herein by reference.

The module 40 is fully manufactured at a factory and is transported to the construction site on an undercarriage. At the homesite, the undercarriage is utilized to align the module 40 relative to the foundation system including the pier column 10. Suitable jacks are then employed to level and align the module 40. After the module 40 is properly located, leveled and aligned, the inner support member 32 is then raised relative to the outer support member 30 until the upper end thereof is brought into engagement with the bottom of the steel beam 44 of the chassis 42 of the module 40. The inner support member 32 is then secured both to the steel beam 44 and to the outer support member 30, preferably by welding. Thus, a welding bead 46 is formed at the point of engagement between the upper end of the inner support member 32 and the bottom surface of the steel beam 44 and a welding bead 48 is formed at the point at which the inner support member 32 emerges from the upper end of the outer support member 30. In this manner pier column 10 and similar pier columns comprising the remainder of the foundation system serve to fully support the module 40.

After all of the inner support members of the pier columns comprising the foundation system are welded in place, the undercarriage which was used to transport the module 40 and the jacks which were used to level and align the modules 40 are removed. A layer 49 comprising asphalt or other protective material may be applied to the pier columns, if desired. In addition, a wall 50 may be formed on the exterior side of the foundation system. The wall 50 may comprise a lath and plaster wall to simulate a concrete grade beam, a brick wall, etc. The purpose of the wall 50 is to hide the foundation system, and thereby provide a more pleasing appearance. It will be understood that the wall 50 plays no part whatsoever in supporting the chassis 40.

Figure 2:
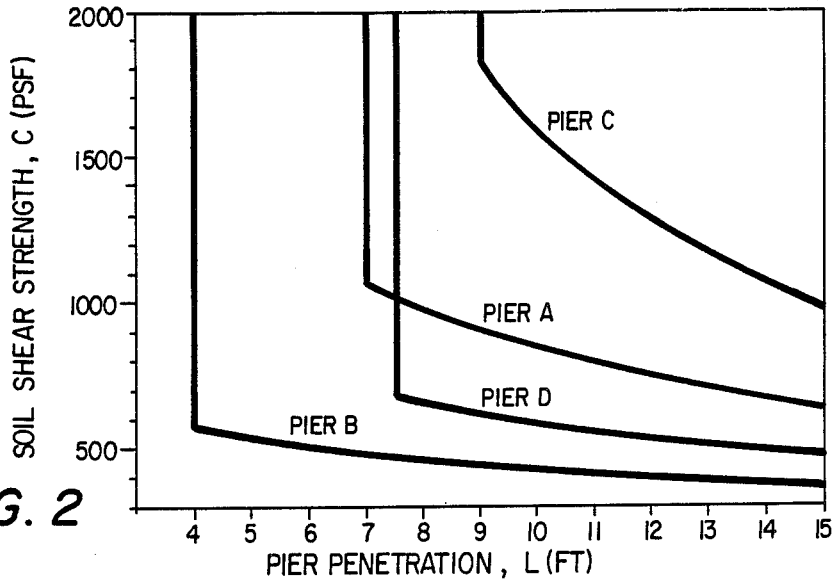
FIG. 2 is a chart useful in determining the minimum depth of foundation posts incorporating the invention.

FIG. 2 shows the minimum depth of bore holes used in forming pier columns of the type shown in FIG. 1 as a function of soil sheer strength, it being understood that the specific curves of FIG. 2 depends upon the parameters of the foundation system. As used in FIG. 2, the term pier A refers to installations in which the bore hole has neither a bell 14 nor a liner 22. The term pier B refers to installations having a bell 14, but not having a liner 22. The term pier C refers to installations having a liner 22, but not having a bell 14. The term pier D refers to installations having both a bell 14 and a liner 22. Piers A and B are for use for nonexpansive cohesive soils and piers C and D are for use with expansive cohesive soils.

In using the chart of FIG. 2, the soil shear strength is preferably determined utilizing a "SOILTEST CL600" in accordance with the manufacturer's instructions. For a given soil shear strength, the minimum bore hole depth is to the right of the appropriate curve. For a given bore hole depth, the minimum soil shear strength is above the appropriate curve.

Figure 3:
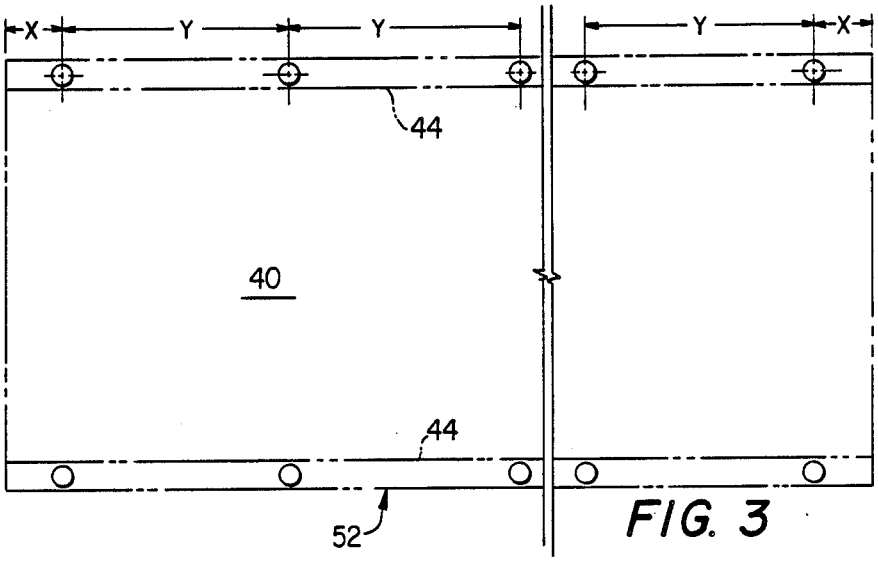
FIG. 3 is a plan view illustrating a typical modular housing foundation constructed in accordance with the invention.

FIG. 3 illustrates the perimeter 52 of the module 40 of FIG. 1. The steel beams 44 extend longitudinally along the opposite sides of the module 40. Dimension X, comprising the distance between the end of the module 40 and the first pier column in the foundation system is preferably 2′ maximum. Dimension Y, comprising the distance between adjacent pier columns preferably does not exceed 8′.

Figure 4:
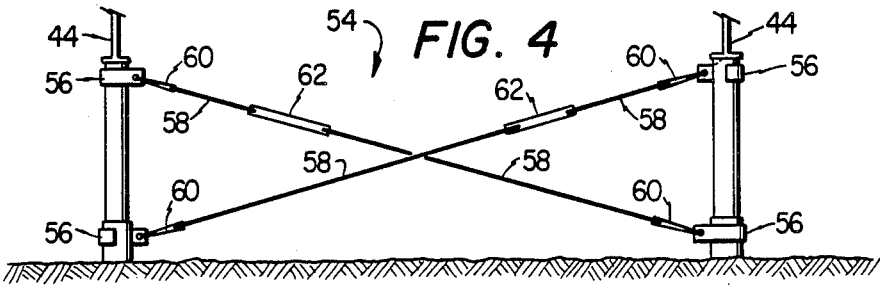
FIG. 4 is an end view of the foundation of FIG. 3.

FIG. 4 illustrates a wind bracing system 54 which is preferably utilized in conjunction with the end most pier columns of the foundation system for the module 40 as shown in FIG. 3. Padeyes 56 comprising J-shaped members formed from $\frac{5}{8}$″ A36 steel plate are secured to the inner and outer support members of the pier columns by welding. Four $\frac{3}{4}$″ diameter A36 threaded steel rods 58 are each provided with a clevis 60 at one end thereof, and each clevis 60 secures one of the rods 58 to one of the padeyes 56. Turnbuckles 62 threadedly interconnect the rod extending from the padeye secured to the upper end of one end of the pier columns to the rod secured to the lower end of the opposite pier column and vice versa. The turnbuckles 62 are adjusted in the conventional manner to provide appropriate tension in the rods 58.

Figure 5:
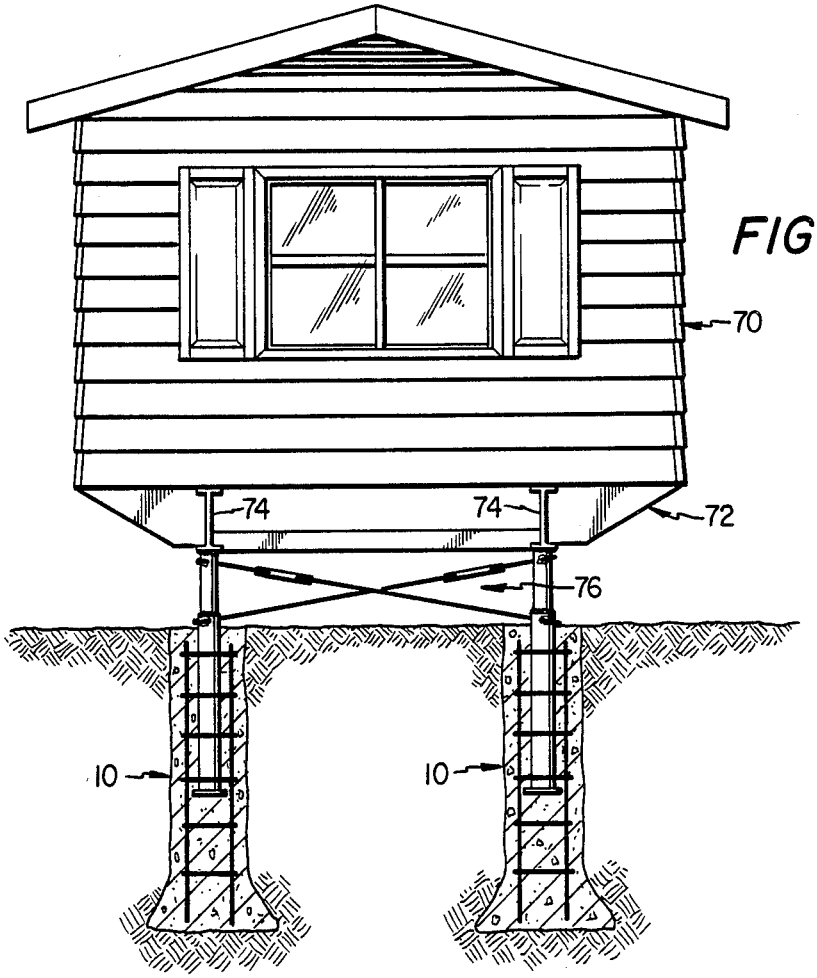
FIG. 5 is an illustration of the use of the invention in conjunction with a single wide mobile home.
Figure 6:
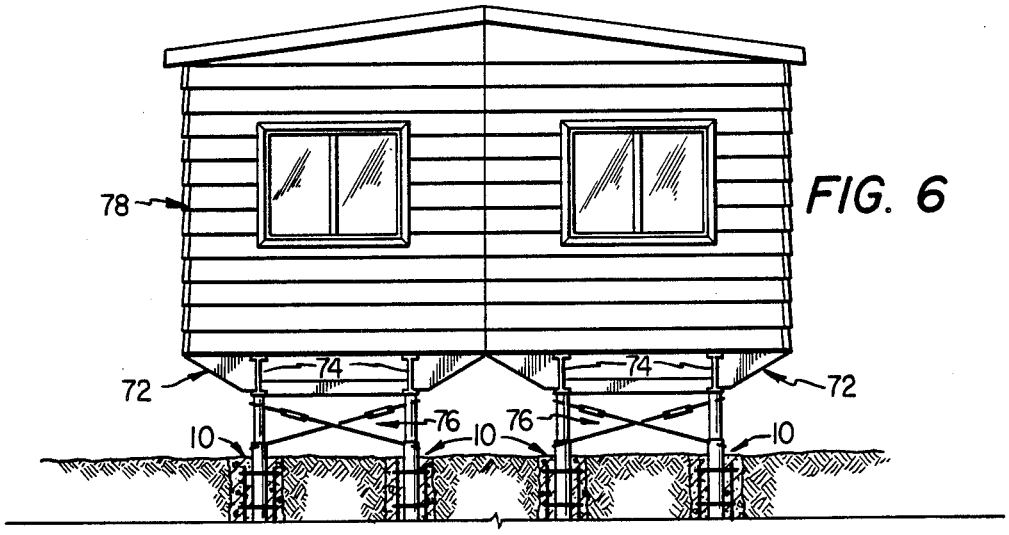
FIG. 6 is an illustration of the use of the invention in conjunction with a double wide mobile home.

FIGS. 5 and 6 illustrate the practice of the invention in conjunction with mobile homes. In FIG. 5 there is shown a single wide mobile home 70 which is supported on a plurality of pier columns 10 of the type illustrated in FIG. 1 and described hereinabove in conjunction therewith. The single wide mobile home 70 includes a chassis 72 comprising longitudinally suspending beams 74 which are supported directly on the pier columns 10. The foundation system for the single wide mobile home 70 is stabilized by a wind bracing system 76 which differs somewhat from the wind bracing system shown in FIG. 4 in that the system 76 comprises tie rod portions having curved ends which are directly welded to the structural components of the pier columns 10, thereby eliminating the need for separate padeyes. FIGS. 6 illustrates a similar application of the invention in conjunction with a double wide mobile home 78.

Although preferred embodiments of the invention have been illustrated in the Drawings and described in the foregoing Detailed Description, it will be understood that the invention is not limited to the embodiments disclosed, but is capable of numerous rearragnements, modifications and substitutions of parts and elements without departing from the spirit of the invention.

I claim:

1. A method of supporting a housing module comprising:

forming a bore hole in the earth to a predetermined depth;

positioning a concrete reinforcing structure in the bore hole;

subsequently filling the bore hole with concrete;

positioning an outer support member in the concrete in the bore hole prior to the setting thereof;

positioning a module over the outer support member;

extending an inner support member between the outer support member and the chassis of the module; and securing the inner support member to the chassis of the module and to the outer support member.

2. The method according to claim 1 wherein the step of positioning a concrete reinforcing structure in the bore hole is further characterized by:

providing a plurality of longitudinal reinforcing bars each having a total length substantially equal to the total depth of the bore hole; and interconnecting the longitudinally extending reinforcing bars by means of a plurality of tie bars positioned at spaced apart intervals lengthwise thereof.

3. The method according to claim 1 wherein the step of positioning an outer support member in the concrete prior to the setting thereof is carried out by positioning a length of $2\frac{1}{2}$″ diameter steel pipe in the concrete with the upper end of the length of steel pipe extending above the upper surface of the concrete, wherein the module is of the type including a chassis comprising a steel beam, and wherein the step of extending an inner support member into engagement with the chassis is carried out by positioning a length of 2″ diameter steel pipe within the length of steel pipe comprising the outer support member, extending the length of steel pipe comprising the inner support member upwardly into engagement with the steel beam of the chassis, and welding the length of steel pipe comprising the inner support member in place.

4. The method according to claim 3 characterized by securing a steel plate to the bottom end of the length of the steel pipe comprising the outer support member prior to the positioning thereof in the concrete.

5. The method according to claim 4 wherein the step of positioning an outer support member comprising the length of steel pipe is further characterized by positioning an outer support member comprising a 3′10″ length of $2\frac{1}{2}$″ diameter standard A53 grade B pipe in the concrete prior to the setting thereof, and wherein the step of positioning an inner support member comprising a length of steel pipe is further characterized by positioning a 4′2″ length of 2″ diameter standard A53 grade B pipe within the outer support member.

6. The method according to claim 5 further characterized by forming a wall around the periphery around the module to give the appearance of a concrete grade beam.

7. The method according to claim 1 wherein the step of positioning an outer support member in the concrete prior to the setting thereof is carried out by the positioning a tubular outer support member in the concrete with the upper end of the tubular outer support member extending above the upper surface of the concrete.

8. The method according to claim 7 further characterized by securing a plate to the bottom end of the tubular outer support member prior to installing the tubular outer support member in the concrete.

9. The method according to claim 7 further characterized by positioning a tubular inner support member within the tubular outer support member prior to the positioning of the module over the outer support member.

10. The method according to claim 9 wherein the outer support member comprises a length of steel pipe, wherein the inner support member comprises a length of steel pipe, wherein the chassis of the undercarriage includes a steel beam, and wherein the inner support member is secured to the chassis of the undercarriage and the outer support member by welding.

11. A method of forming a foundation system for modules having chassis including longitudinally extending steel beams comprising the steps of:

forming a bore hole in the earth to a predetermined depth;

providing a concrete reinforcing structure including a plurality of reinforcing members each having a length substantially equal to the depth of the bore hole and a plurality of tie members positioned at longitudinally spaced apart intervals for interconnecting the longitudinally extending members;

positioning the concrete reinforcing structure in the bore hole;

filling the bore hole with concrete;

providing an outer support member comprising a length of steel pipe having a steel plate secured to the bottom end thereof;

positioning the outer support member in the concrete in the bore hole prior to the setting of the concrete;

providing an inner support member comprising a length of steel pipe having an outside diameter adapted to fit within the inside diameter of the outer support member;

positioning the inner support member within the outer support member;

positioning the module above the inner and outer support members;

extending the inner support member outwardly from the outer support member into engagement with the steel beam of the chassis of the module; and securing the inner support member to the steel beam of the chassis of the module and to the outer support member, thereby supporting the module.

12. The method according to claim 11 wherein the step of positioning the outer support member in the concrete prior to the setting thereof is further characterized by positioning the outer support member in the concrete with the upper end of the outer support member extending above the upper surface of the concrete.

13. The method according to claim 11 wherein the step of securing the inner support member to the steel beam of the chassis of the module and to the outer support member is carried out by welding.

* * * * *